US008896618B2

(12) United States Patent
Kwon et al.

(10) Patent No.: US 8,896,618 B2
(45) Date of Patent: Nov. 25, 2014

(54) LIQUID CRYSTAL DISPLAY DEVICE AND METHOD OF DRIVING THE SAME

(75) Inventors: Yong-Hoon Kwon, Asan-si (KR); Gi-Cherl Kim, Yongin-si (KR); Se-Ki Park, Suwon-si (KR); Moon-Hwan Chang, Yongin-si (KR); Dong-Min Yeo, Asan-si (KR); Ho-Sik Shin, Anyang-si (KR)

(73) Assignee: Samsung Display Co., Ltd. (KR)

( * ) Notice: Subject to any disclaimer, the term of this patent is extended or adjusted under 35 U.S.C. 154(b) by 1188 days.

(21) Appl. No.: 12/501,301

(22) Filed: Jul. 10, 2009

(65) Prior Publication Data

US 2010/0134512 A1 Jun. 3, 2010

(30) Foreign Application Priority Data

Dec. 1, 2008 (KR) ..... 10-2008-0120521

(51) Int. Cl.
*G09G 3/36* (2006.01)
*G09G 3/34* (2006.01)

(52) U.S. Cl.
CPC ..... *G09G 3/3426* (2013.01); *G09G 3/3413* (2013.01); *G08G 2320/0242* (2013.01); *G09G 2320/0247* (2013.01); *G09G 2320/0285* (2013.01); *G09G 2320/04* (2013.01); *G09G 2320/0666* (2013.01); *G09G 2360/16* (2013.01)
USPC ..... 345/589; 345/102

(58) Field of Classification Search
CPC ..... G09G 3/3413; G09G 3/3426; G09G 2320/0242; G09G 2320/0247; G09G 2320/0285; G09G 2320/04; G09G 2320/0666; G09G 2360/16
USPC ..... 345/38, 47–48, 63, 77, 87, 90, 690
See application file for complete search history.

(56) References Cited

U.S. PATENT DOCUMENTS

| | | | | |
|---|---|---|---|---|
| 2006/0238487 | A1 * | 10/2006 | Shih | 345/102 |
| 2007/0115228 | A1 * | 5/2007 | Roberts et al. | 345/82 |
| 2008/0042968 | A1 * | 2/2008 | Oh | 345/102 |
| 2009/0115720 | A1 * | 5/2009 | Inada et al. | 345/102 |

FOREIGN PATENT DOCUMENTS

| | | |
|---|---|---|
| JP | 2008-010397 | 1/2008 |
| KR | 2005-0112952 | 12/2005 |
| KR | 2008-0032440 | 4/2008 |
| WO | WO 2007007472 A1 * | 1/2007 |

* cited by examiner

*Primary Examiner* — Amare Mengitsu
*Assistant Examiner* — Stacy Khoo
(74) *Attorney, Agent, or Firm* — Innovation Counsel LLP

(57) ABSTRACT

A liquid crystal display device and a method of driving the same are provided for one or more embodiments. The liquid crystal display device includes: a liquid crystal panel including a plurality of display blocks and displaying an image in response to image signals; a plurality of light-emitting blocks emitting light to the liquid crystal panel and corresponding to the plurality of display blocks; a first look-up table including a normalized value obtained by normalizing an initial duty ratio corresponding to the brightness of the image to a maximum duty ratio corresponding to the maximum brightness of the image; and a timing controller receiving the normalized value corresponding to each of the light-emitting blocks from the first look-up table and using the normalized value to provide an optical data signal corresponding to each of the light-emitting blocks.

15 Claims, 9 Drawing Sheets

Fig. 6A

| GRAY LEVEL | R | G | B |
|---|---|---|---|
| 0 | 0 | 0 | 0 |
| 1 | 0.015 | 0.011 | 0.003 |
| 2 | 0.055 | 0.044 | 0.014 |
| 3 | 0.095 | 0.086 | 0.032 |
| ~ | ~ | ~ | ~ |
| 100 | 0.811 | 0.807 | 0.879 |
| 101 | 0.814 | 0.809 | 0.887 |
| 102 | 0.83 | 0.827 | 0.904 |
| ~ | ~ | ~ | ~ |
| 180 | 0.946 | 0.924 | 1.026 |
| 181 | 0.944 | 0.924 | 1.023 |
| 182 | 0.943 | 0.924 | 1.032 |
| ~ | ~ | ~ | ~ |
| 253 | 1.005 | 0.998 | 1.012 |
| 254 | 1.001 | 0.997 | 0.999 |
| 255 | 1 | 1 | 1 |

Fig. 6B

| GRAY LEVEL | White | | |
|---|---|---|---|
| | R | G | B |
| 0 | 0 | 0 | 0 |
| 1 | 0.011 | 0.011 | 0.011 |
| 2 | 0.042 | 0.042 | 0.042 |
| 3 | 0.074 | 0.074 | 0.074 |
| ~ | ~ | ~ | ~ |
| 100 | 0.688 | 0.688 | 0.688 |
| 101 | 0.691 | 0.691 | 0.691 |
| 102 | 0.706 | 0.706 | 0.706 |
| ~ | ~ | ~ | ~ |
| 180 | 0.894 | 0.894 | 0.894 |
| 181 | 0.895 | 0.895 | 0.895 |
| 182 | 0.895 | 0.895 | 0.895 |
| ~ | ~ | ~ | ~ |
| 253 | 1.008 | 1.008 | 1.008 |
| 254 | 1.002 | 1.002 | 1.002 |
| 255 | 1 | 1 | 1 |

Fig. 6C

| BOOSTING LEVEL | CURRENT LEVEL (mA) | | | MAXIMUM DUTY RATIO(%) | | |
|---|---|---|---|---|---|---|
| | R | G | B | R | G | B |
| 0 | 10 | 10 | 10 | 85 | 90 | 90 |
| 1 | 11 | 11 | 11 | 88 | 88 | 90 |
| 2 | 13 | 13 | 13 | 95 | 90 | 85 |
| 3 | 14 | 14 | 14 | 92 | 90 | 90 |
| 4 | 15 | 15 | 15 | 88 | 95 | 95 |
| 5 | 16 | 16 | 16 | 85 | 90 | 92 |
| 6 | 17 | 17 | 17 | 83 | 90 | 88 |
| 7 | 19 | 19 | 19 | 87 | 91 | 90 |
| 8 | 20 | 20 | 20 | 90 | 93 | 90 |
| 9 | 21 | 21 | 21 | 93 | 95 | 93 |
| ≀ | ≀ | ≀ | ≀ | ≀ | ≀ | ≀ |
| 32 | 60 | 60 | 60 | 98 | 95 | 98 |

LIQUID CRYSTAL DISPLAY DEVICE AND METHOD OF DRIVING THE SAME

CROSS-REFERENCE TO RELATED APPLICATION

This application claims priority to and benefit of Korean Patent Application No. 10-2008-0120521, filed on Dec. 1, 2008 in the Korean Intellectual Property Office, the contents of which are incorporated herein by reference in their entirety.

BACKGROUND

1. Technical Field

The present invention relates generally to a liquid crystal display device and a method of driving the same, and more particularly, for example, to a liquid crystal display device with high display quality and a method of driving the same.

2. Related Art

Liquid crystal display devices include liquid crystal panels, each having a first display panel having pixel electrode formed therein, a second display panel having a common electrode formed therein, and a liquid crystal layer that has dielectric anisotropy that is interposed between the first display panel and the second display panel. An electric field is formed between the pixel electrode and the common electrode, and the intensity of the electric field is adjusted to control the amount of light passing through the liquid crystal panel, thereby displaying a desired image. Since the liquid crystal display device is not a self-emission type, it requires a light source that emits light to the liquid crystal panel.

Recently, as the light source, light-emitting diodes (LEDs) have drawn attention. A backlight unit using light-emitting diodes as a light source may perform local dimming in order to increase a contrast ratio and reduce power consumption. During the local dimming, when a portion of the image is dark and a portion thereof is bright, the amount of light of the bright portion is insufficient, which results in image distortion. In this case, so-called local boosting that drives a specific light-emitting block to emit light with high brightness can be performed.

However, because the same image on a screen is viewed in different colors before and after the local boosting, undesirable severe flickering occurs.

SUMMARY

Aspects of one or more embodiments may provide a liquid crystal display device with high display quality.

Aspects of one or more embodiment can provide a method of driving a liquid crystal display device with high display quality.

However, the aspects, features and advantages of embodiments of the present invention are not restricted to the ones set forth herein. The above and other aspects, features and advantages of embodiments of the present invention will become more apparent to one of ordinary skill in the art to which the present invention pertains by referencing a detailed description of embodiments of the present invention given below.

According to an aspect of an embodiment, there is provided a liquid crystal display device including: a liquid crystal panel including a plurality of display blocks and displaying an image in response to image signals; a plurality of light-emitting blocks emitting light to the liquid crystal panel and corresponding to the plurality of display blocks; a first look-up table including a normalized value obtained by normalizing an initial duty ratio corresponding to the brightness of the image to a maximum duty ratio corresponding to the maximum brightness of the image; and a timing controller receiving the normalized value corresponding to each of the light-emitting blocks from the first look-up table and using the normalized value to provide an optical data signal corresponding to each of the light-emitting blocks.

According to an aspect of an embodiment, there is provided a method of driving a liquid crystal display device, the method including: providing a liquid crystal panel that includes a plurality of display blocks and displays an image in response to image signals; receiving normalized values from a first look-up table, emitting light to the liquid crystal panel, and designating the normalized values to a plurality of light-emitting blocks corresponding to the plurality of display blocks; and determining optical data signals using the normalized values. The first look-up table includes the normalized value obtained by normalizing an initial duty ratio corresponding to the brightness of the image to a maximum duty ratio corresponding to the maximum brightness of the image.

BRIEF DESCRIPTION OF THE DRAWINGS

The above and other aspects and features of embodiments of the present invention will become more apparent by describing in detail exemplary embodiments thereof with reference to the attached drawings, in which:

FIGS. 6A to 6C are diagrams illustrating an example of the operation of the optical data signal output unit shown in FIG. 5 according to an example of an embodiment;

DETAILED DESCRIPTION

Figure 1:
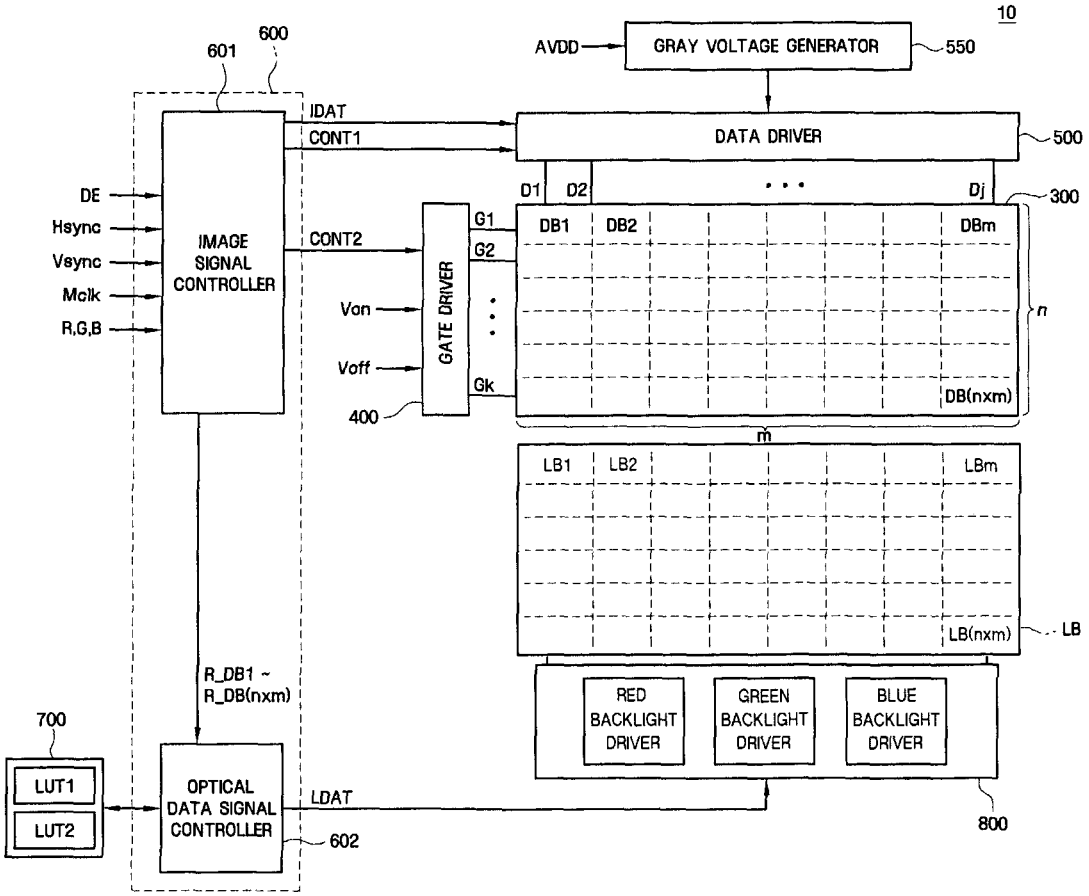
FIG. 1 is a block diagram illustrating a liquid crystal display device and a method of driving the same according to an example of an embodiment.

Advantages and features of embodiments of the present invention and methods of accomplishing the same may be understood more readily by reference to the following detailed description of examples of embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the present invention to those skilled in the art. Thus, the present invention will only be defined by the appended claims. Like reference numerals refer to like elements throughout the specification.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Hereinafter, a liquid crystal display device and a method of driving the same according to one or more embodiments will be described with reference to FIGS. 1 to 7B.

Figure 2:
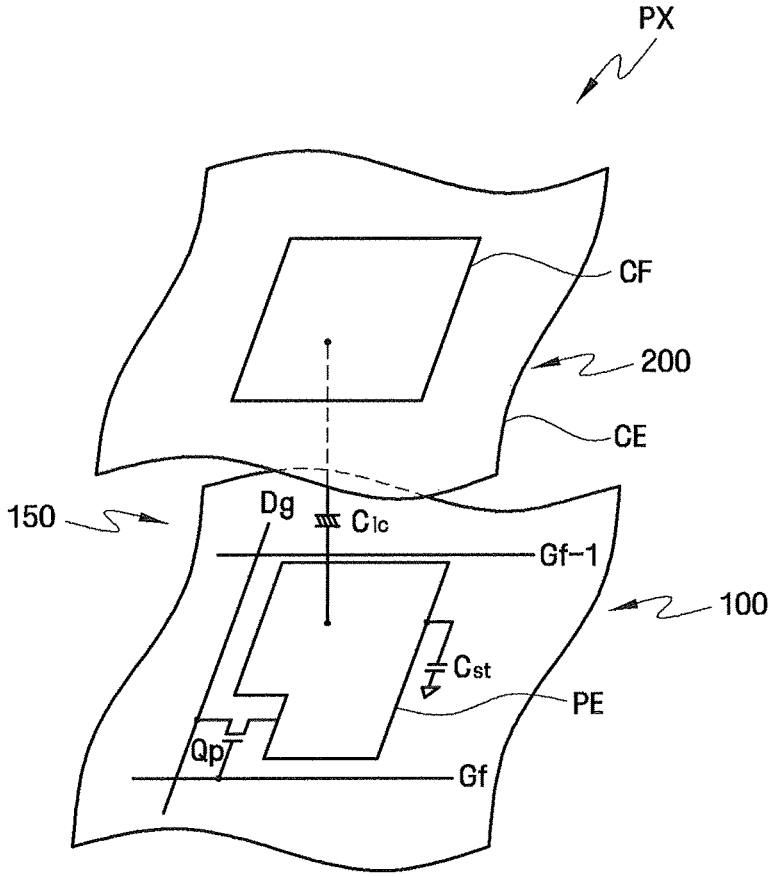
FIG. 2 is an equivalent circuit diagram illustrating one pixel included in a liquid crystal panel shown in FIG. 1 according to an example of an embodiment.
Figure 3:
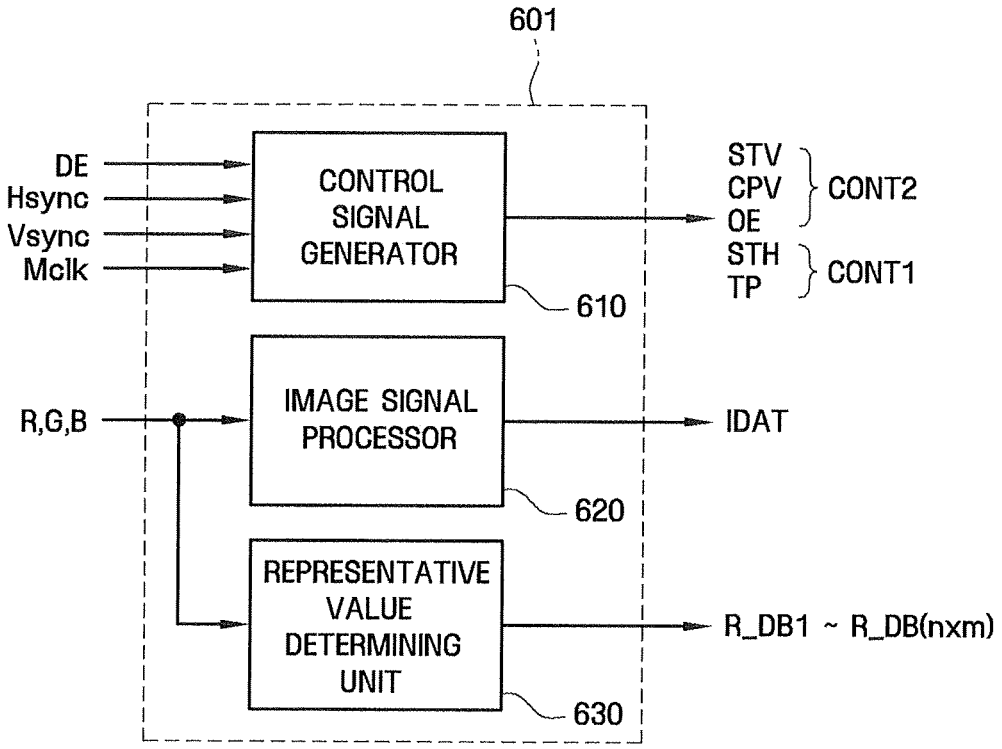
FIG. 3 is a block diagram illustrating the image signal controller shown in FIG. 1 according to an example of an embodiment.
Figure 4:
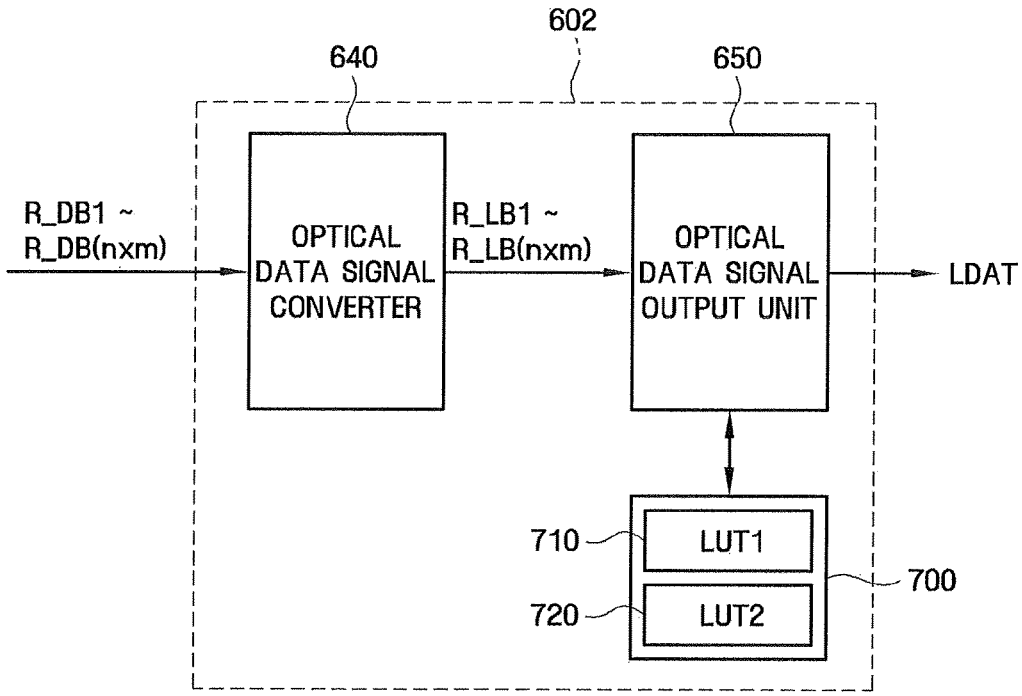
FIG. 4 is a block diagram illustrating the optical data signal controller shown in FIG. 1 according to an example of an embodiment.
Figure 5:
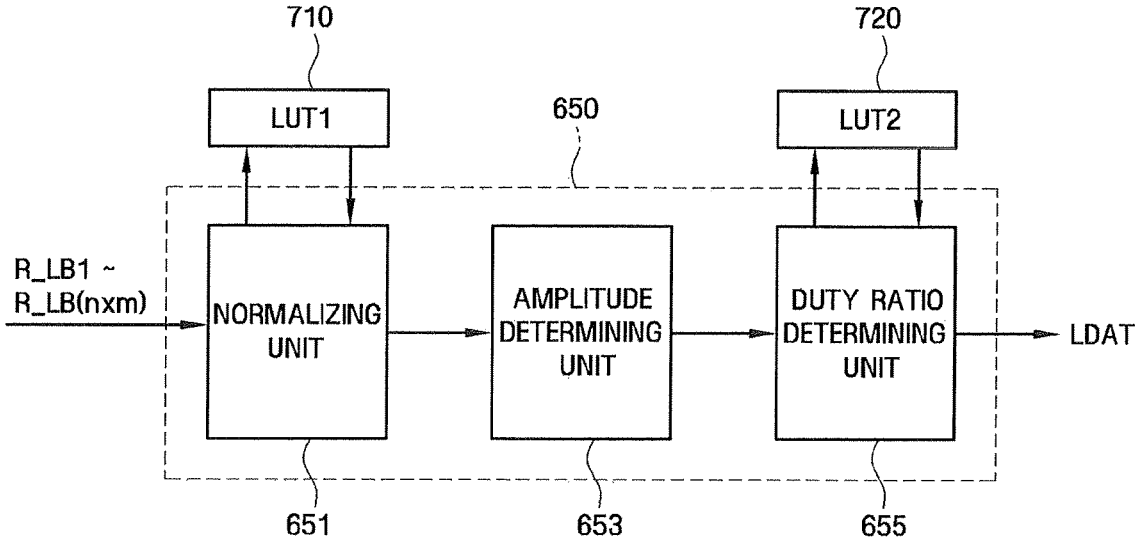
FIG. 5 is a block diagram illustrating the optical data signal output unit shown in FIG. 4 according to an example of an embodiment.
Figure 7A:
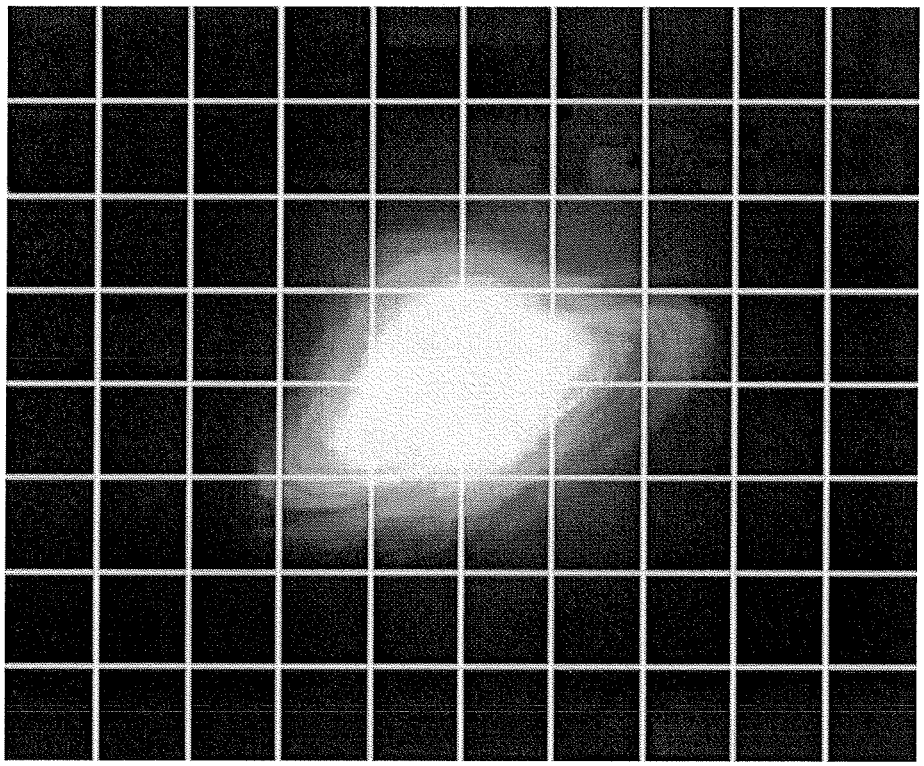
FIGS. 7A and 7B are diagrams illustrating an example of the operation of the optical data signal output unit shown in FIG. 5 according to an example of an embodiment.
Figure 7B:
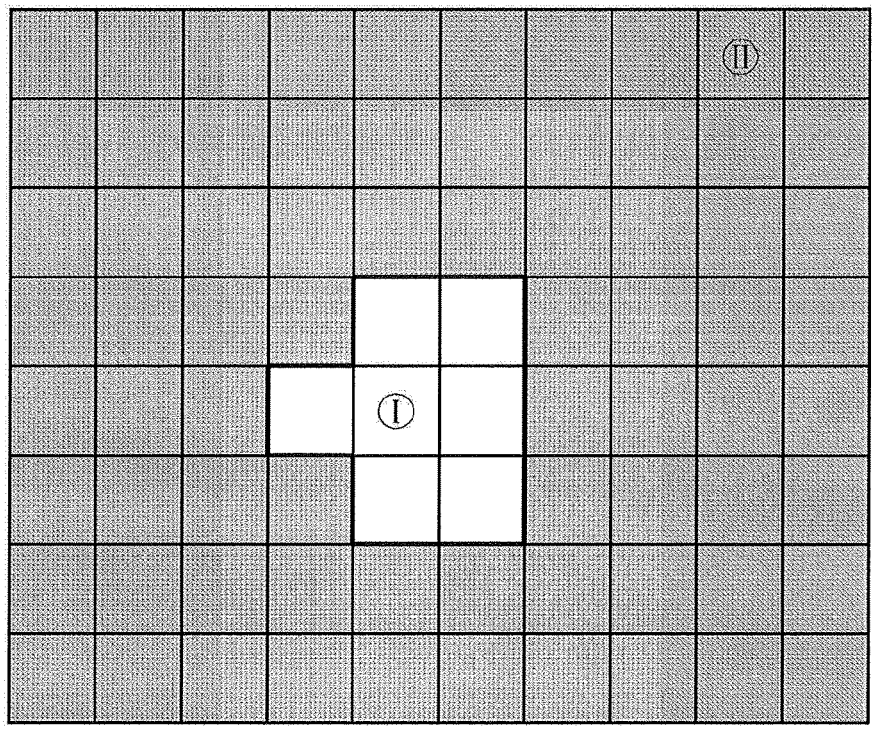

FIG. 1 is a block diagram illustrating a liquid crystal display device and a method of driving the same according to an embodiment. FIG. 2 is an equivalent circuit diagram illustrating one pixel of the liquid crystal panel shown in FIG. 1 according to an example of an embodiment. FIG. 3 is a block diagram illustrating the image signal controller shown in FIG. 1 according to an example of an embodiment. FIG. 4 is a block diagram illustrating the optical data signal controller shown in FIG. 1 according to an example of an embodiment. FIG. 5 is a block diagram illustrating the optical data signal output unit shown in FIG. 4 according to an example of an embodiment. FIGS. 6A to 6C are diagrams illustrating an example of the operation of the optical data signal output unit shown in FIG. 5 according to an example of an embodiment. FIGS. 7A and 7B are diagrams illustrating an example of the operation of the optical data signal output unit shown in FIG. 5 according to an example of an embodiment.

Referring to FIG. 1, a liquid crystal display device 10 includes a liquid crystal panel 300, a timing controller 600, a gray voltage generator 550, a gate driver 400, a data driver 500, a backlight driver 800, and a light-emitting block LB connected to the backlight driver 800.

The liquid crystal panel 300 includes a plurality of display blocks DB1 to DB(n×m). For example, a plurality of display blocks DB1 to DB(n×m) may be arranged in an n-by-m matrix. Each of the display blocks DB1 to DB(n×m) may include a plurality of pixels. Although not shown in the drawings, a plurality of pixels may be divided into red sub-pixels, green sub-pixels, and blue sub-pixels, as would be understood by one of ordinary skill in the art. The liquid crystal panel 300 further includes a plurality of gate lines G1 to Gk and a plurality of data lines D1 to Dj, and the pixels may be defined at intersections between the gate lines and the data lines. The liquid crystal panel 300 displays an image in response to image signals, which will be described below.

In the drawings, one light-emitting block LB is shown. However, if necessary, the light-emitting block LB may be composed of a plurality of light-emitting blocks LB1 to LB(n×m) corresponding to a plurality of display blocks DB1 to DB(n×m). In this embodiment, an example in which the light-emitting block LB is composed of a plurality of light-emitting blocks LB1 to LB(n×m) will be described. However, the present invention is not limited thereto.

FIG. 2 shows an equivalent circuit of one pixel. For example, a pixel PX connected to an f-th (f=1 to k) gate line Gf and a g-th (g=1 to j) data line Dg includes a switching element Qp that is connected to the gate line Gf and the data line Dg, and a liquid crystal capacitor Clc and a storage capacitor Cst connected to the switching element. As shown in FIG. 2, the liquid crystal capacitor Clc may include two electrodes, for example, a pixel electrode PE of a first display panel 100 and a common electrode CE of a second display panel 200, and liquid crystal molecules 150 interposed between the two electrodes. Color filters CF are formed in a portion of the common electrode CE.

Referring to FIG. 1 again, the timing controller 600 may receive first image signals R, G, and B and external control signals Vsync, Hsync, Mclk, and DE for displaying the first image signals R, G, and B, and output a second image signal IDAT, a data control signal CONT1, a gate control signal CONT2, and an optical data signal LDAT.

The timing controller 600 may convert the first image signals R, G, and B into the second image signals IDAT and output the converted signals. In addition, the timing controller 600 may provide the optical data signals LDAT corresponding to the image displayed on the liquid crystal panel 300 to the backlight driver 800. Specifically, the timing controller 600 receives normalized values corresponding to the light-emitting blocks LB1 to LB(n×m) from a first look-up table LUT1 (710) including the normalized values obtained by normalizing an initial duty ratio corresponding to the brightness of each image into a maximum duty ratio corresponding the maximum brightness of the image, and uses the normalized values to provide optical data signals corresponding to the light-emitting blocks.

Further, the timing controller 600 may determine the initial brightness of each of the light-emitting blocks LB1 to LB(n×m) corresponding to image signals, and determine the amplitude of the optical data signal LDAT on the basis of the ratio of the number of low-brightness light-emitting blocks having an initial brightness that is lower than a reference brightness to the number of high-brightness light-emitting blocks having an initial brightness that is higher than the reference brightness among a plurality of light-emitting blocks LB1 to LB(n×m).

The timing controller 600 may receive a maximum duty ratio from a second look-up table LUT2 (720) including the maximum duty ratio corresponding to the ratio of the number of low-brightness light-emitting blocks having an initial brightness that is lower than the reference brightness to the number of high-brightness light-emitting blocks having an initial brightness that is higher than the reference brightness among the plurality of light-emitting blocks LB1 to LB(n×m), that is, the ratio of the low-brightness light-emitting blocks, and use the maximum duty ratio to adjust the duty ratio of the optical data signal LDAT. For example, it is possible to calculate the duty ratio of the optical data signal LDAT by multiplying the normalized value of each of the light-emitting blocks LB1 to LB(n×m) supplied from the first look-up table LUT1 (710) by the maximum duty ratio supplied from the second look-up table LUT2 (720). The liquid crystal display device that designates the normalized value corresponding to the initial brightness of each of the light-emitting blocks LB1 to LB(n×m) has an advantage in that, even when the current level of each light-emitting block is increased as in local boosting, color coordinates are maintained, which makes it possible to improve display quality.

In this way, the timing controller 600 can provide the optical data signal LDAT whose duty ratio and/or amplitude is adjusted to correspond to the image displayed by the liquid crystal panel 300, which will be described in detail below.

The timing controller 600 may be functionally divided into an image signal controller 601 and an optical data signal controller 602. The image signal controller 601 may control the image displayed on the liquid crystal panel 300, and the optical data signal controller 602 may control the operation of the backlight driver 800. The image signal controller 601 and the optical data signal controller 602 may be physically separated from each other.

The image signal controller 601 may receive the first image signals R, G, and B and output the second image signals IDAT corresponding thereto. In addition, the image signal controller 601 may receive the external control signals Vsync, Hsync, Mclk, and DE and generate the data control signal CONT1 and the gate control signal CONT2. Examples of the external control signals include a vertical synchronization signal Vsync, a horizontal synchronization signal Hsync, a main clock signal Mclk, and a data enable signal DE. The data control signal CONT1 is for controlling the operation of the data driver 500, and the gate control signal CONT2 is for controlling the operation of the gate driver 400.

The image signal controller 601 may receive the first image signals R, G, and B, and output representative image signals R_DB1 to R_DB(n×m) corresponding to the received signals to the optical data signal controller 602.

Referring to FIG. 3, the image signal controller 601 may include a control signal generator 610, an image signal processor 620, and a representative value determining unit 630.

The control signal generator 610 receives the external control signals Vsync, Hsync, Mclk, and DE and outputs the data control signal CONT1 and the gate control signal CONT2. For example, the control signal generator 610 may output a vertical start signal STV that starts the operation of the gate driver 400, a gate clock signal CPV that determines the output time of a gate-on voltage, an output enable signal OE that determines the pulse width of the gate-on voltage, a horizontal start signal STH that starts the operation of the data driver 400, and an output instruction signal TP that instructs the output of an image data voltage.

The image signal processor 620 may convert the first image signals R, G, and B into the second image signals IDAT and output the converted signals. The second image signals IDAT may be converted from the first image signals R, G, and B in order to improve display quality. For example, the second image signals IDAT may be converted from the first image signals R, G, and B in order to perform overdriving.

The representative value determining unit 630 determines the representative image signals R_DB1 to R_DB(n×m) respectively corresponding to the display blocks DB1 to DB(n×m). For example, the representative value determining unit 630 may receive R, G, and B image signals R, G, and B and determine the representative image signals R_DB1 to R_DB(n×m). Each of the representative image signals R_DB1 to R_DB(n×m) may be the average value of the R, G, and B image signals R, G, and B supplied to each of the display blocks DB1 to DB(n×m). Therefore, each of the representative image signals R_DB1 to R_DB(n×m) may mean the initial average brightness of each of the display blocks DB1 to DB(n×m), that is, the initial brightness of each of the display blocks DB1 to DB(n×m). Each of the representative image signals R_DB1 to R_DB(n×m) may mean the gray level of each of the display blocks DB1 to DB(n×m). The representative value determining unit 630 may use the image data signal IDAT to determine the representative image signals R_DB1 to R_DB(n×m) of the display blocks DB1 to DB(n×m), unlike the structure shown in the drawings.

Referring to FIG. 1 again, the optical data signal controller 602 may receive the representative image signals R_DB1 to R_DB(n×m) and output the optical data signal LDAT to the backlight driver 800. The optical data signal controller 602 may provide the optical data signal LDAT whose duty ratio and/or amplitude is adjusted to correspond to the image displayed by the liquid crystal panel 300.

Referring to FIG. 4, the optical data signal controller 602 may include an optical data signal converter 640 and an optical data signal output unit 650.

The optical data signal converter 640 receives a plurality of representative image signals R_DB1 to R_DB(n×m) and determines the average brightness of the R, G, and B image signals R, G, and B, that is, the initial brightness of each of the display blocks DB1 to DB(n×m). As described above, since the representative image signals R_DB1 to R_DB(n×m) indicate the average brightness of the display blocks DB1 to DB(n×m), the optical data signal converter 640 may average the representative image signals R_DB1 to R_DB(n×m) to calculate the initial brightness of each of the display blocks DB1 to DB(n×m). That is, the optical data signal converter 640 may receive a plurality of representative image signals R_DB1 to R_DB(n×m), determine the initial brightness of each of the light-emitting blocks LB1 to LB(n×m) corresponding to an image signal, and output the initial brightness of each of the light-emitting blocks LB1 to LB(n×m) to the optical data signal output unit 650.

The optical data signal output unit 650 may receive the initial brightnesses R_LB1 to R_LB(n×m) of the light-emitting blocks, and output the optical data signals LDAT corresponding to the light-emitting blocks LB1 to LB(n×m) using look-up tables 700.

The look-up tables 700 include a first look-up table LUT1 (710) and a second look-up table LUT2 (720). The first look-up table LUT1 (710) includes a normalized value obtained by normalizing an initial duty ratio corresponding to the brightness of an image into a duty ratio of maximum gray level corresponding to the maximum brightness of the image. The second look-up table LUT2 (720) may include a maximum duty ratio corresponding to the ratio of the low-brightness light-emitting blocks.

The operation of the optical data signal output unit 650 using the first look-up table LUT1 (710) and the second look-up table LUT2 (720) to output the optical data signals LDAT corresponding to the light-emitting blocks LB1 to LB(n×m) will be described in detail below.

Referring to FIG. 1 again, the gray voltage generator 550 may supply an image data voltage corresponding to the second image signal IDAT to the data driver 500. The gray voltage generator 550 may divide a driving voltage AVDD according to the gray level of the second image signal IDAT and supply the divided voltage to the data driver 500. The gray voltage generator 550 may include a plurality of resistors connected in series between a node to which the driving voltage AVDD is applied and the ground in order to divide the level of the driving voltage AVDD. The internal circuit structure of the gray voltage generator 550 is not limited thereto, but the gray voltage generator 550 may have various internal circuit structures.

The gate driver 400 receives the gate control signal CONT2 from the image signal controller 601 and supplies gate signals to the gate lines G1 to Gk. The gate signal is composed of a combination of a gate-on voltage Von and a gate-off voltage Voff supplied from a gate-on/off voltage generator. The gate control signal CONT2 is for controlling the operation of the gate driver 400, and may include, for example, a vertical start signal that starts the operation of the gate driver 500, a gate clock signal that determines the output time of the gate-on voltage, and an output enable signal that determines the pulse width of the gate-on voltage.

The data driver 500 receives the data control signal CONT1 from the image signal controller 601 and supplies an image data voltage to the data lines D1 to Dj. The image data voltage may be supplied from the gray voltage generator 550. That is, the image data voltage may be divided from the driving voltage AVDD according to the gray level of the second image signal IDAT. The data control signal CONT1 includes signals for controlling the operation of the data driver 500. The signals for controlling the operation of the data driver 500 may include, for example, a horizontal start signal that starts the operation of the data driver 500 and an output instruction signal that instructs the output of the image data voltage.

The backlight driver 800 may adjust the brightness of light emitted from the light-emitting blocks LB1 to LB(n×m) in response to the optical data signal LDAT. The backlight driver 800 may receive the optical data signal LDAT from the timing controller 600, determine the duty ratio and the amplitude of a current on the basis of the optical data signal LDAT corresponding to each of the light-emitting blocks LB1 to LB(n×m), and apply the current to the light-emitting blocks LB1 to LB(n×m). The plurality of light-emitting blocks LB1 to LB(n×m) each may include at least one light source, that is, a to light-emitting diode (LED).

The optical data signals may include red, green, and blue optical data signals, and the backlight driver 800 may include red, green, and blue backlight drivers that supply currents corresponding to the red, green, and blue optical data signals.

Referring to FIG. 5, the optical data signal output unit 650 of the timing controller 600 may include a normalizing unit 651, an amplitude determining unit 653, and a duty ratio determining unit 655.

The normalizing unit 651 may use the first look-up table LUT1 (710) to designate normalized values corresponding to the light-emitting blocks LB1 to LB(n×m). As described above, the normalizing unit 651 receives the initial brightness of each light-emitting block from the optical data signal converter (see reference numeral 640 of FIG. 4). The normalizing unit 651 may receive normalized values corresponding to the initial brightnesses of the light-emitting blocks from the first look-up table LUT1(710) and designate the normalized values to the light-emitting blocks LB1 to LB(n×m).

As shown in FIG. 6A, for example, the first look-up table LUT1 (710) may include the normalized values of red (R), green (G), and blue (B) for each gray level. In the drawings, the normalized values for each 'gray level' are shown as an example, but the term 'gray level' may correspond to 'brightness'. For example, when the initial brightness of a light-emitting block corresponds to gray level 102, normalized values of 0.83, 0.827, and 0.904 may be respectively designated to R, G, and B in the light-emitting block. As described above, the normalized value included in the first look-up table LUT 1 (710) may be obtained by normalizing an initial duty ratio corresponding to each brightness value to a maximum duty ratio corresponding to the maximum brightness of an image. For example, it is possible to calculate the normalized value by dividing an initial duty ratio corresponding to each brightness value by the duty ratio of maximum gray level, for example 255 gray level.

FIG. 6B is a diagram illustrating an example of the first look-up table LUT1 (710). FIG. 6B shows the first look-up table including the normalized values of R, G, and B for each gray level when a light-emitting diode is a white diode. This is just an illustrative example and the present invention is not limited thereto.

Referring to FIG. 5 again, the amplitude determining unit 653 may determine the amplitude of the optical data signal LDAT on the basis of the ratio of the low-brightness light-emitting blocks having an initial brightness that is lower then the reference brightness among the plurality of light-emitting blocks LB1 to LB(n×m).

Specifically, as shown in FIG. 7A, when an image is displayed on the liquid crystal panel (see reference numeral 300 of FIG. 1), the representative value determining unit (see reference numeral 630 of FIG. 3) may determine the representative image signals R_DB1 to R_DB(n×m) respectively corresponding to the display blocks DB1 to DB(n×m), and the optical data signal converter (see reference numeral 640 of FIG. 4) may determine the initial brightnesses of the display blocks DB1 to DB(n×m) on the basis of the representative image signals R_DB1 to RDB(n×m). The amplitude determining unit 653 receives the optical data signals including the normalized values of the light-emitting blocks LB1 to LB(n×m), and calculates the ratio of the low-brightness light-emitting blocks having an initial brightness corresponding to the normalized value of each of the light-emitting blocks LB1 to LB(n×m) that is lower than a predetermined reference brightness among the plurality of light-emitting blocks LB1 to LB(n×m). In this case, the reference brightness varies depending on the purpose of the liquid crystal display device, but is not limited to a specific value.

As shown in FIG. 7B, it is possible to check whether the light-emitting blocks LB1 to LB(n×m) are low-brightness light-emitting blocks. In FIG. 7B, a bright portion I indicates the high-brightness light-emitting block having an initial brightness that is higher than the reference brightness, and a dark portion II indicates the low-brightness light-emitting block having an initial brightness that is lower than the reference brightness.

As shown in FIG. 7B, when light-emitting blocks are arranged in an 8-by-10 matrix, the number of low-brightness light-emitting blocks is 73 among a total of 80 light-emitting blocks, and the ratio of the low-brightness light-emitting blocks is about 0.9125. In this case, when a predetermined reference ratio is less than 0.9125, the amplitude of the optical data signal LDAT may be increased by a predetermined ratio. For example, when the reference ratio is set to 0.75 and the ratio of the low-brightness light-emitting blocks to all the light-emitting blocks is more than 0.75, the amplitude of the optical data signal LDAT may be increased. On the other hand, when the ratio of the low-brightness light-emitting blocks is less than 0.75, the amplitude of the optical data signal LDAT may be maintained without any change. The amplitude of the optical data signal LDAT may mean the magnitude of the current applied to the light-emitting blocks LB1 to LB(n×m). That is, the adjustment of the amplitude of the optical data signal LDAT may mean the adjustment of the magnitude of the current applied to the light-emitting blocks LB1 to LB(n×m).

Referring to FIG. 5 again, the duty ratio determining unit 655 may receive a maximum duty ratio corresponding to the ratio of the low-brightness light-emitting blocks from the second look-up table LUT2 (720) and determine the duty ratio of the optical data signal LDAT using the maximum duty ratio and the normalized values of the light-emitting blocks LB1 to LB(n×m).

As shown in FIG. 6C, for example, the second look-up table LUT2 (720) may include the maximum duty ratios of R, G, and B for each boosting level. The boosting level corresponds to the amplitude of the optical data signal determined by the amplitude determining unit (see reference numeral 650 of FIG. 5). For example, when the amplitude determining unit 653 maintains the amplitude of the optical data signal LDAT, the boosting level is '0'. The boosting level may vary from '1' to '32' depending on the amplitude of the optical data signal LDAT. In FIG. 6C, the current levels of R, G, and B for each boosting level are shown, but this is just an illustrative example. The current levels may vary depending on the purpose and/or the characteristics of a liquid crystal display device. Consequently, the second look-up table LUT2 (720) may include a maximum duty ratio corresponding to the ratio of the low-brightness light-emitting blocks.

Referring to FIG. 5 again, the duty ratio determining unit 655 receives the optical data signal including the amplitude determined by the amplitude determining unit 653 and the normalized value determined by the normalizing unit 651, and also receives a maximum duty ratio corresponding to the boosting level of the optical data signal from the second look-up table LUT2 (720). The duty ratio determining unit 655 determines the duty ratio of the optical data signal using the normalized value of each of the light-emitting blocks LB1 to LB(n×m) and the maximum duty ratio corresponding to the boosting level. For example, the duty ratio of the optical data signal may be calculated by multiplying the normalized value of each of the light-emitting blocks LB1 to LB(n×m) by the maximum duty ratio. For example, when the normalized values of R, G, and B of a light-emitting block are 0.83, 0.827, and 0.904, respectively, and the boosting level is '3', the maximum duty ratios of R, G, and B corresponding to the boosting level '3' are 92%, 90%, and 90%, respectively. Therefore, the optical data signal of the light-emitting block may include a current level of 14 mA and duty ratios of 76.36% (0.83×92%), 74.43% (0.827×90%), and 81.36% (0.904×90%) for R, G, and B, respectively.

According to the liquid crystal display device and the method of driving the same according to this embodiment, normalized values corresponding to the initial brightnesses of a plurality of light-emitting blocks are designated. Therefore, even when the amplitude and the duty ratio of an optical data signal are adjusted, it is possible to maintain color coordinates and reduce flickering. As a result, it is possible to improve display quality.

Next, a liquid crystal display device and a method of driving the same according to an embodiment is described with reference to FIG. 8. The liquid crystal display device and the method of driving the same according to this embodiment differs from the liquid crystal display device and the method of driving the same according to the above-described embodiment in that, before the normalized value of each light-emitting block is designated, it is determined whether to increase the amplitude of an optical data signal on the basis of the ratio of the low-brightness light-emitting blocks. In this embodiment, the same components as those according to the above-described embodiment are denoted by the same reference numerals. Therefore, a description is focused on the difference between this embodiment and the above-described embodiment.

Figure 8:
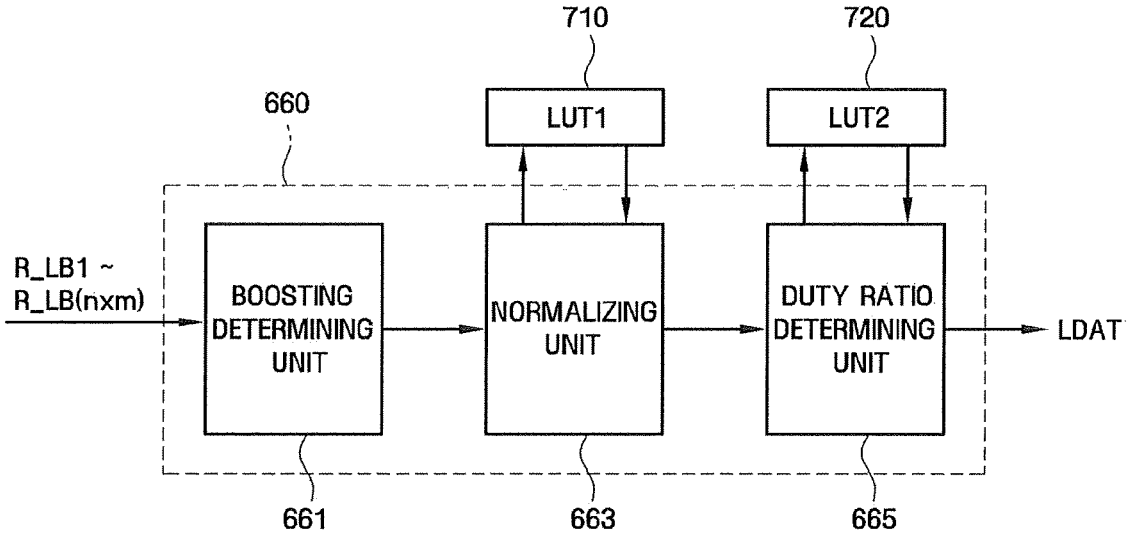
FIG. 8 is a block diagram illustrating a liquid crystal display device and a method of driving the same according to an example of an embodiment.

FIG. 8 is a block diagram illustrating an optical data signal output unit of the liquid crystal display device according to an embodiment.

Referring to FIG. 8, an optical data signal output unit 660 of the liquid crystal display device according to this embodiment includes a boosting determining unit 661, a normalizing unit 663, and a duty ratio determining unit 665.

The boosting determining unit 661 may determine whether to increase the amplitude of the optical data signal on the basis of the ratio of the low-brightness light-emitting blocks. Specifically, if the ratio of the low-brightness light-emitting blocks is more than a reference ratio, the boosting determining unit may increase the amplitude of the optical data signal according to the ratio of the low-brightness light-emitting blocks. If the ratio of the low-brightness light-emitting blocks is less than the reference ratio, the boosting determining unit may maintain the amplitude of the optical data signal. The boosting determining unit 661 determines whether to increase the brightness of each of the light-emitting blocks LB1 to LB(n×m) before the normalizing unit 663 designates the normalized values of the light-emitting blocks LB1 to LB(n×m). Therefore, as described above, if the ratio of the low-brightness light-emitting blocks is less than the reference ratio, the boosting determining unit 661 can output the optical data signals LDAT corresponding to the initial brightnesses of the light-emitting blocks LB1 to LB(n×m) without using the normalizing unit 663 and the duty ratio determining unit 665.

If the ratio of the low-brightness light-emitting blocks is more than the reference ratio, the boosting determining unit 661 outputs the optical data signals LDAT corresponding to the initial brightnesses of the light-emitting blocks LB1 to LB(n×m) to the normalizing unit 663. The normalizing unit 663 searches normalized values corresponding to the initial brightnesses of the light-emitting blocks LB1 to LB(n×m) from the first look-up table LUT1 (710) and designates the normalized values to the plurality of light-emitting blocks LB1 to LB(n×m). The optical data signals LDAT having the normalized values of the light-emitting blocks LB1 to LB(n×m) are transmitted to the duty ratio determining unit 665. The duty ratio determining unit 665 may search a maximum duty ratio corresponding to the ratio of the low-brightness light-emitting blocks from the second look-up table LUT2 (720), and apply the maximum duty ratio to the normalized value of each of the light-emitting blocks LB1 to LB(n×m). For example, the duty ratio determining unit 665 may multiply the normalized value of each of the light-emitting blocks LB1 to LB(n×m) by the maximum duty ratio to determine the duty ratio of the optical data signal LDAT.

According to the liquid crystal display device and the method of driving the same of this embodiment, it is possible to improve display quality by designating the normalized values corresponding to the initial brightnesses of a plurality of light-emitting blocks.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display device comprising:

a liquid crystal panel including a plurality of display blocks and adapted to display an image in response to image signals;

a plurality of light-emitting blocks adapted to emit light to the liquid crystal panel and corresponding to the plurality of display blocks;

a first look-up table including a normalized value; and a timing controller adapted to receive the normalized value corresponding to each of the light-emitting blocks from the first look-up table and use the normalized value to provide an optical data signal corresponding to each of the light-emitting blocks, wherein the normalized value is obtained by dividing an initial duty ratio corresponding to a brightness value by a duty ratio corresponding to a maximum gray level, wherein the timing controller determines an initial brightness of each of the light-emitting blocks corresponding to the image signal, and determines an amplitude of the optical data signal on the basis of a ratio of the low-brightness light-emitting blocks, wherein the ratio of the low-brightness light-emitting blocks corresponds to a ratio of a number of low-brightness light-emitting blocks having an initial brightness that is lower than a reference brightness to a number of high-brightness light-emitting blocks having an initial brightness that is higher than the reference brightness among the plurality of light-emitting blocks, and wherein: the amplitude of the optical data signal is increased according to the ratio of the low-brightness light-emitting blocks, if the ratio of the low-brightness light-emitting blocks is more than a reference ratio; and the amplitude of the optical data signal is maintained without any change, if the ratio of the low-brightness light-emitting blocks is less than the reference ratio.

2. The liquid crystal display device of claim 1, further comprising a second look-up table including a maximum duty ratio corresponding to the ratio of the low-brightness light-emitting blocks, wherein the timing controller is further adapted to receive the maximum duty ratio from the second look-up table and use the maximum duty ratio to determine a duty ratio of the optical data signal.

3. The liquid crystal display device of claim 2, wherein the duty ratio of the optical data signal is determined by multiplying the normalized value supplied from the first look-up table by the maximum duty ratio supplied from the second look-up table.

4. The liquid crystal display device of claim 2, wherein the timing controller includes:

a normalizing unit adapted to use the first look-up table to designate the normalized value corresponding to each of the light-emitting blocks;

an amplitude determining unit adapted to determine the amplitude of the optical data signal on the basis of the ratio of the low-brightness light-emitting blocks; and a duty ratio determining unit adapted to receive the maximum duty ratio corresponding to the ratio of the low-brightness light-emitting blocks from the second look-up table, and multiply the normalized value of each of the light-emitting blocks by the maximum duty ratio to determine the duty ratio of the optical data signal.

5. The liquid crystal display device of claim 2, wherein the timing controller is adapted to:

receive the normalized value corresponding to the initial brightness of each of the light-emitting blocks from the first look-up table, and designate the normalized value to each of the light-emitting blocks;

determine the amplitude of the optical data signal on the basis of the ratio of the low-brightness light-emitting blocks; and multiply the normalized value of each of the light-emitting blocks by the maximum duty ratio corresponding to the ratio of the low-brightness light-emitting blocks to determine the duty ratio of the optical data signal.

6. The liquid crystal display device of claim 5, further comprising a second look-up table including the maximum duty ratio corresponding to the ratio of the low-brightness light-emitting blocks, wherein the timing controller is adapted to receive the maximum duty ratio from the second look-up table and use the maximum duty ratio to determine the duty ratio of the optical data signal.

7. The liquid crystal display device of claim 1, wherein the timing controller includes:

a boosting determining unit adapted to determine whether to increase the amplitude of the optical data signal on the basis of the ratio of the low-brightness light-emitting blocks;

a normalizing unit adapted to designate the normalized value corresponding to each of the light-emitting blocks using the first look-up table, according to the determination result of the boosting determining unit; and a duty ratio determining unit adapted to multiply the designated normalized value of each of the light-emitting blocks by the maximum duty ratio corresponding to the ratio of the low-brightness light-emitting blocks to determine the duty ratio of the optical data signal.

8. The liquid crystal display device of claim 7, further comprising a second look-up table including the maximum duty ratio corresponding to the ratio of the low-brightness light-emitting blocks, wherein the timing controller is adapted to receive the maximum duty ratio from the second look-up table and use the maximum duty ratio to determine the duty ratio of the optical data signal.

9. The liquid crystal display device of claim 1, further comprising a backlight driver adapted to receive the optical data signal from the timing controller and apply a current corresponding to the optical data signal to each of the light-emitting blocks.

10. The liquid crystal display device of claim 9, wherein:

the optical data signal includes red, green, and blue optical data signals; and the backlight driver includes first to third backlight drivers that supply currents corresponding to the red, green, and blue optical data signals.

11. A method of driving a liquid crystal display device, the method comprising:

providing a liquid crystal panel that includes a plurality of display blocks and displays an image in response to image signals;

receiving normalized values from a first look-up table, emitting light to the liquid crystal panel, and designating the normalized values to a plurality of light-emitting blocks corresponding to the plurality of display blocks;

determining optical data signals using the normalized values;

determining an initial brightness of each of the light-emitting blocks corresponding to the image signal; and determining an amplitude of an optical data signal on the basis of a ratio of the low-brightness light emitting blocks, wherein the first look-up table includes the normalized value obtained by dividing an initial duty ratio corresponding to a brightness value by a duty ratio corresponding to a maximum gray level, wherein the ratio of the low-brightness light-emitting blocks corresponds to a ratio of a number of low-brightness light-emitting blocks having an initial brightness that is lower than a reference brightness to a number of high-brightness light-emitting blocks having an initial brightness that is higher than the reference brightness among the plurality of light-emitting blocks, and wherein: the amplitude of the optical data signal is increased according to the ratio of the low-brightness light-emitting blocks, if the ratio of the low-brightness light-emitting blocks is more than a reference ratio; and the amplitude of the optical data signal is maintained without any change, if the ratio of the low-brightness light-emitting blocks is less than the reference ratio.

12. The method of claim 11, wherein the determining of the optical data signal includes receiving the maximum duty ratio from a second look-up table which includes a maximum duty ratio corresponding to the ratio of the low-brightness light-emitting blocks, and determining a duty ratio of the optical data signal using the maximum duty ratio.

13. The method of claim 12, wherein the determining of the duty ratio of the optical data signal is carried out by multiplying the normalized value supplied from the first look-up table by the maximum duty ratio supplied from the second look-up table.

14. The method of claim 11, further comprising:

receiving a normalized value corresponding to the initial brightness of each of the light-emitting blocks from the first look-up table, and designating the normalized value corresponding to each of the light-emitting blocks;

determining the amplitude of the optical data signal on the basis of the ratio of the low-brightness light-emitting blocks; and multiplying the normalized value of each of the light-emitting blocks by the maximum duty ratio corresponding to the ratio of the low-brightness light-emitting blocks to determine the duty ratio of the optical data signal.

15. The method of claim 11, wherein the optical data signal includes red, green, and blue optical data signals.

* * * * *